United States Patent [19]

Harriman

[11] Patent Number: 4,557,185

[45] Date of Patent: Dec. 10, 1985

[54] SOLENOID OPERATED EXHAUST AIR DAMPER

[76] Inventor: Ronald M. Harriman, Rte. 3, Twin Falls, Id. 83301

[21] Appl. No.: 634,821

[22] Filed: Jul. 26, 1984

[51] Int. Cl.[4] ..... F23J 25/08

[52] U.S. Cl. ..... 98/116; 126/285 B; 137/601; 251/129.22

[58] Field of Search ..... 98/116, 122; 137/601; 126/285 R, 285 B, 292; 251/129, 140

[56] References Cited

U.S. PATENT DOCUMENTS

| | | | |
|---|---|---|---|
| 928,815 | 7/1909 | Stevison . | |
| 2,326,957 | 8/1943 | Maguire | 98/29 |
| 2,342,925 | 2/1944 | Den Besten et al. | 126/285 R |
| 2,597,560 | 5/1952 | Beyrodt | 4/250 |
| 2,688,141 | 9/1954 | Filliung | 4/101 |
| 2,786,210 | 3/1957 | Fraser | 4/101 |
| 2,922,614 | 1/1960 | Nickells | 251/140 |
| 2,999,191 | 9/1961 | Muradian et al. | 317/141 |
| 3,010,451 | 11/1961 | Hodgins | 126/285 B |
| 3,056,143 | 10/1962 | Foster | 4/249 |
| 3,604,480 | 9/1971 | Reichert et al. | 251/140 |
| 3,990,356 | 11/1976 | Keller | 251/11 |
| 4,085,667 | 4/1978 | Christianson | 98/43 |
| 4,314,585 | 2/1982 | Nishimiya et al. | 251/129 |

*Primary Examiner*—Ronald C. Capossela
*Attorney, Agent, or Firm*—Frank J. Dykas

[57] ABSTRACT

A solenoid operated exhaust damper having a housing designed for installation as a segment of an exhaust air duct and upper and lower adaptor sleeves for connecting the housing to exhaust ducting of conforming size and shape. Inside the housing, attached to mounting means is a solenoid having an energized and deenergized position for its solenoid shaft. Included is a plunger, disposed within said housing, and plunger seating means, attached to the housing, for forming an airtight seal with the plunger when the solenoid is deenergized. A coiled spring is installed in compressive engagement with both the mounting means and the plunger and adapted for pressing the plunger against the plunger seat when the solenoid is deenergized. A control rod connects the plunger to the solenoid shaft and is adapted to pull the plunger away from the plunger seat when the solenoid is energized.

6 Claims, 3 Drawing Figures

SOLENOID OPERATED EXHAUST AIR DAMPER

BACKGROUND OF THE INVENTION

The present invention relates to a new and improved solenoid operated exhaust air damper for use in exhaust air systems which utilize exhaust air fans. Such exhaust air systems are commonplace and can be found in virtually every household bathroom and kitchen. They are found in houses, apartments, hotels, office buildings, industrial complexes and factories and so forth.

There are many varieties and designs of exhaust air fans which are in common use today.

The typical installation of a household exhaust air system utilizes an exhaust air fan mounted in the ceiling, drawing its suction directly from the room. Typically, the exhaust air fan has a decorative louver covering the suction. The fan exhausts the air into a duct, normally made of sheet metal, up through the ceiling and roof of the building. Normally there is some sort of a raincap atop the exhaust duct to keep rain, snow and the elements out of the exhaust duct system.

Typical exhaust air fans are designed to run on household current, and are wired to an on/off switch or timer normally located in the vicinity of the light switch to the room.

With the normal installation, there is no damper or other means of closing the exhaust duct when the fan is not in use. Thus, there is an open passageway for air to either enter or leave the house. In the winter the heated inside air can flow, by convection, or by venturi suction, directly to the outside. If, for example, the exhaust duct is circular with a four inch diameter, the result is that the exhaust air system represents a four inch hole in the roof of the building.

SUMMARY OF THE INVENTION

Hence it is a primary object of the present invention to provide an exhaust air damper which will remain closed and air-tight, forming an air-tight closure for all times when the exhaust air system is not being used, and that will automatically open to provide for the exhaustion of air when the exhaust air fan is in operation.

Another object of this invention is to build an inexpensive exhaust air damper with few moving parts and a simplicity of operation.

A third object of this invention is to provide an exhaust air damper which is readily adaptable to a variety of exhaust air ducting sizes and shapes, and additionally that is readily connected to the same electrical control system utilized for the exhaust air fan.

These objects are accomplished by use of the solenoid operated exhaust air damper which is described herein. In general the solenoid operated exhaust air damper herein described is entirely contained within a housing which is designed to be inserted as a segment of the exhaust air ducting, preferably directly above the exhaust air fan. Upper and lower sleeves are provided for attachment to the housing so that a standard sized solenoid operated exhaust air damper can be utilized with a variety of different exhaust air ducting sizes and shapes. The upper and lower sleeves are designed to allow the insertion of the exhaust air damper into an exhaust ducting system.

In the preferred embodiment, there is found within the housing a multiple use mounting means which has attached to it a solenoid. It should be noted that the solenoid can also be mounted outside of the housing.

The solenoid is designed to have both an energized and a deenergized position for the solenoid shaft. That is to say when power is applied to the solenoid, it moves to an energized position and when the power is removed, it returns to a deenergized position. There is a plunger disposed within the housing and adapted for movement within the housing on an axis coinciding with the axis of the exhaust air passage way defined by the housing. Within the housing there are plunger seating means which are designed to form an air-tight seal with the plunger when the solenoid is in the deenergized position.

A coiled spring is provided for compressive engagement with both the mounting means and the plunger and adapted for pressing the plunger against the plunger seating means when the solenoid is in the deenergized position. There is a control rod attaching the plunger to the solenoid shaft so that when the solenoid is in the energized position the plunger is retracted away from the plunger seating means, thus allowing exhaust air to pass through the exhaust air duct.

Power for the solenoid is provided from the same source as the power to the exhaust air fan. If the solenoid operated exhaust air damper is mounted directly to the exhaust air fan, the solenoid can easily and quickly be wired to the exhaust fan's power supply.

If the fan and solenoid are wired to the same electrical source, then when the fan is turned on the exhaust air damper automatically opens, and when the fan is turned off the solenoid is deenergized and the coiled spring pushes the plunger against the plunger seat, thus sealing off the exhaust air duct.

DETAILED DESCRIPTION OF THE PREFERRED EMBODIMENT

Figure 1:
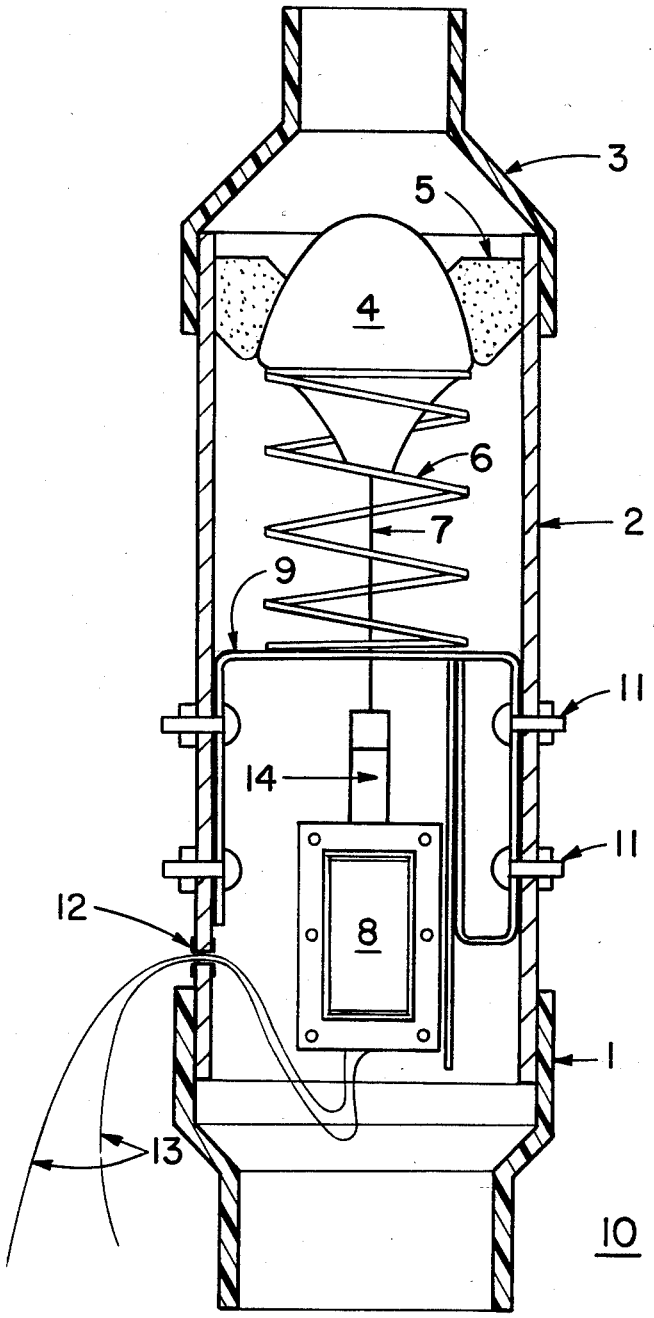
FIG. 1 illustrates in sectional view details of the preferred embodiment of the solenoid operated exhaust air damper in a deenergized, closed position.

First referring to FIG. 1, the solenoid operated exhaust air damper is generally referred to as 10. Exhaust air housing 2 can be generally described as circular piping of a suitable material, preferably a lightweight yet strong plastic. Mounting means 9 are disposed within housing 2 and attached thereto by fastening means 11. Attached to mounting means 9 is the solenoid 8.

The power leads 13 for solenoid 8 pass through collar 12 found in housing 2. Said power leads 13 are of a length sufficient to be readily connected to the power leads for an exhaust air fan which, in the preferred embodiment is what the solenoid operated exhaust air damper 10 is mounted directly to.

Figure 2:
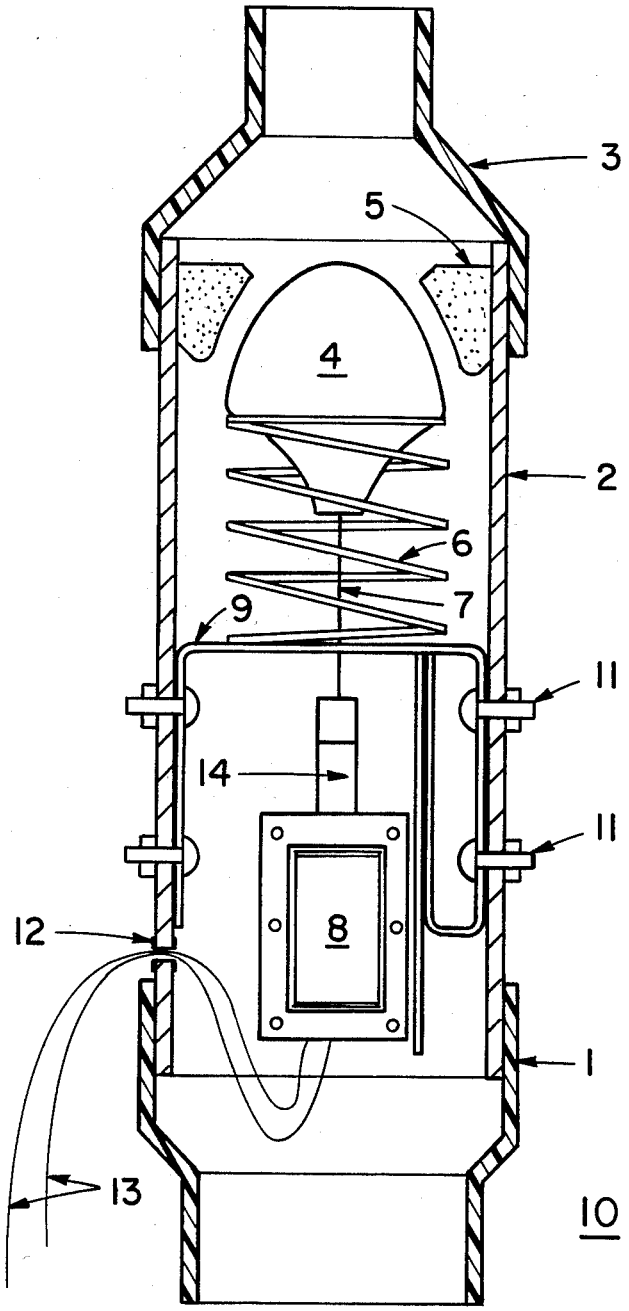
FIG. 2 illustrates the same sectional view in an energized or open position.

The plunger seating means 5 are attached to housing 2 and are designed to provide an air-tight seal when plunger 4 is pressed against plunger seating means 5. Referring to FIGS. 1 and 2 it can be seen that when plunger 4 is retracted away from plunger seating means 5, air is allowed to freely pass through the exhaust air damper.

Solenoid 8 is designed to have an automatic return to a deenergized position. When solenoid 8 is in the deenergized position solenoid shaft 14 is fully extended and coiled spring 6, which is in compression against mounting means 9 and plunger 4, pushes plunger 4 against plunger seating means 5. When solenoid 8 is energized, solenoid shaft 14 is retracted to the energized position causing control rod 7, which attaches plunger 4 to solenoid 8, to retract or pull plunger 4 away from plunger seating means 5, thus allowing air to flow.

If the power leads 13 for solenoid 8 are wired directly to the exhaust fan, then when the exhaust fan is turned on, the solenoid is automatically energized and air is allowed to pass. As soon as the exhaust fan is turned off the solenoid operated exhaust air damper will automatically close, thus providing an air-tight seal.

In the preferred embodiment plunger 4 and plunger seating means 5 are made of a resilient material having high insulation value properties so as to minimize heat loss directly through the materials of which the exhaust air damper is made.

Figure 3:
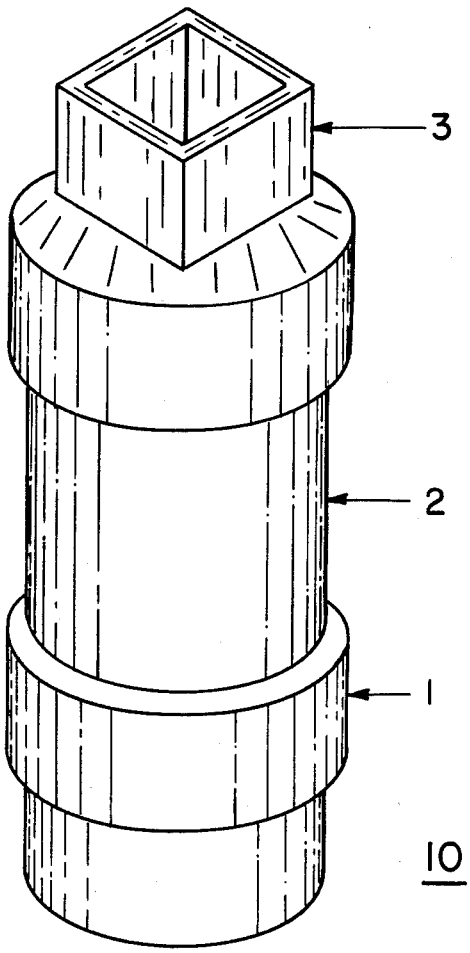
FIG. 3 is a perspective of the exhaust air damper with upper and lower adaptor sleeves attached.

Referring to FIGS. 1 and 3 it can be seen that adaptor sleeves 1 and 3 are provided for engagement with housing 2. In this manner the exhaust air damper can be made of a more or less uniform size, with the use of adaptor sleeves to allow installation in any number of differently designed exhaust air systems. For example, the exhaust air fan discharge may be circular and have a three inch diameter while the exhaust air ducting may be square ducting with dimensions of two inches by six inches. In such a case the adaptor sleeves of the appropriate size and shape can be utilized with a universal housing 2.

It should also be noted that the solenoid operated exhaust air damper 10 can be installed with the plunger either at the top, at the bottom or even in a horizontal position.

While there is shown and described the present preferred embodiment of the invention, it is to be distinctly understood that the invention is not limited thereto but may be variously embodied to practice within the scope of the following claims.

Accordingly, what I claim is:

1. The solenoid operated exhaust damper which comprises:

(a) a housing defining a passageway for exhausting air, adapted for installation as a segment of an exhaust air duct;

(b) mounting means disposed within said housing;

(c) a solenoid having both an energized and deenergized position for its solenoid shaft attached to said mounting means in a position wherein the direction of motion of the solenoid shaft is parallel to the axis of the exhaust air passageway;

(d) a plunger disposed within the housing and adapted for movement within the housing on an axis coinciding with the axis of exhaust air passageway;

(e) plunger seating means attached to the housing for forming an air-tight seal with the plunger when the solenoid is in the deenergized position;

(f) a coiled spring in compressive engagement with both the mounting means and the plunger and adapted for pressing the plunger against the plunger seating means when the solenoid is in the deenergized position;

(g) control rod means connecting the plunger to the solenoid shaft and adapted to pull the plunger away from engagement with the plunger seating means when the solenoid is energized.

2. The apparatus of claim 1 wherein said exhaust damper further includes upper and lower adaptor sleeves for attachment to the upper and lower ends of said housing and adapted for connection with exhaust ducting of conforming size and shape.

3. The solenoid operated exhaust damper of claim 1 wherein said plunger seating means is further comprised of a resilient material having high insulation value properties.

4. The solenoid operated exhaust damper of claim 3 wherein said plunger is further comprised of materials having high insulation valued properties.

5. A solenoid operated exhaust damper for use with exhaust fan systems which comprises:

(a) a housing defining a passageway for exhausting air, adapted for installation as a segment of an exhaust air duct;

(b) upper and lower adaptor sleeves for attachment to the upper and lower ends of said housing and adapted for connection with exhaust ducting of conforming size and shape;

(c) mounting means dispersed within said housing;

(d) a solenoid having an energized and deenergized position for its solenoid shaft attached to said mounting means in a position wherein the direction of motion of the solenoid shaft is parallel to the axis of the exhaust air passageway;

(e) a plunger disposed within the housing and adapted for movement within the housing on an axis coinciding with the axis of exhaust air passageway;

(f) said plunger being constructed of materials having high insulation value properties;

(g) plunger seating means attached to the housing for forming an air-tight seal with the plunger when the solenoid is in the deenergized position;

(h) said seating means being made of a resilient material having high insulation value properties;

(i) a coiled spring in compressive engagement with both the mounting means and the plunger and adatped for pressing the plunger against the plunger seating means when the solenoid is in the deenergized position;

(j) control rod means connecting the plunger to the solenoid shaft and adapted to pull the plunger away from engagement with the plunger seating means when the solenoid is energized.

6. The solenoid operated exhaust air damper of claim 5 wherein said apparatus further comprises energization means for energizing the solenoid when the exhaust fan is in operation.

* * * * *